United States Patent [19]

Ansite

[11] Patent Number: 4,606,340

[45] Date of Patent: Aug. 19, 1986

[54] COMBINED PRESSURE COMPENSATING EXHALATION AND ANTI-SUFFOCATION VALVE

[75] Inventor: William K. Ansite, Glendale, Calif.

[73] Assignee: Figgie International Inc., Willoughby, Ohio

[21] Appl. No.: 513,699

[22] Filed: Jul. 14, 1983

[51] Int. Cl.[4] ..... A62B 7/00

[52] U.S. Cl. ..... 128/205.24; 128/207.12; 137/522; 251/63.4

[58] Field of Search ..... 128/201.28, 205.24, 128/206.15, 207.16; 137/522; 251/63.4

[56] References Cited

U.S. PATENT DOCUMENTS

| | | | |
|---|---|---|---|
| 2,359,008 | 9/1944 | Smith | 251/144 |
| 2,473,518 | 6/1949 | Garrard et al. | 128/142 |
| 2,629,375 | 2/1953 | Holmes | 128/140 |
| 2,828,740 | 4/1958 | Kindred | 128/142 |
| 3,050,054 | 8/1962 | Jones | 128/142 |
| 3,189,027 | 6/1965 | Bartlett, Jr. | 128/142 |
| 3,256,898 | 6/1966 | Ringrose | 137/64 |
| 3,342,200 | 9/1967 | Wilcox | 137/102 |
| 3,362,420 | 1/1968 | Blackburn et al. | 137/81 |
| 3,366,108 | 1/1968 | Blackburn et al. | 128/205.24 |
| 3,444,857 | 5/1969 | Godel | 128/142 |
| 3,459,216 | 8/1969 | Bloom et al. | 137/512.1 |
| 3,688,794 | 9/1972 | Bird et al. | 128/205.24 |

*Primary Examiner*—Henry J. Recla

*Attorney, Agent, or Firm*—Christel, Bean & Linihan

[57] ABSTRACT

A combined pressure compensated exhalation and anti-suffocation valve assembly of the type which may find utility in an aviator's breathing mask. The valve assembly (14) includes a valve body (20) provided with an exhaust port (44) and a compensated pressure chamber (62) in communication with the mask cavity through an orifice tube (72). Disposed within the valve body (14) are a movable diaphragm assembly (22) and an exhaust port plate (24) supported by and movable toward and away from the diaphragm assembly. There is a lost motion connection (106, 108 or 138, 140) extending between the diaphragm assembly and the exhaust port plate, the connection being capable of permitting the exhaust port plate to move relative to the diaphragm assembly within a predetermined range of movements, the parts being so arranged and constructed that if during an inspiratory effort the diaphragm assembly attempts to move away from the exhaust port plate a distance greater than that permitted by the lost motion connection means, as would be the case if the breathing gas supply fails to deliver an adequate supply of gas to the mask cavity, the diaphragm assembly acting through the lost motion connection means will cause corresponding movement of the exhaust port plate thereby opening the mask cavity to ambient.

10 Claims, 5 Drawing Figures

Fig. 3.
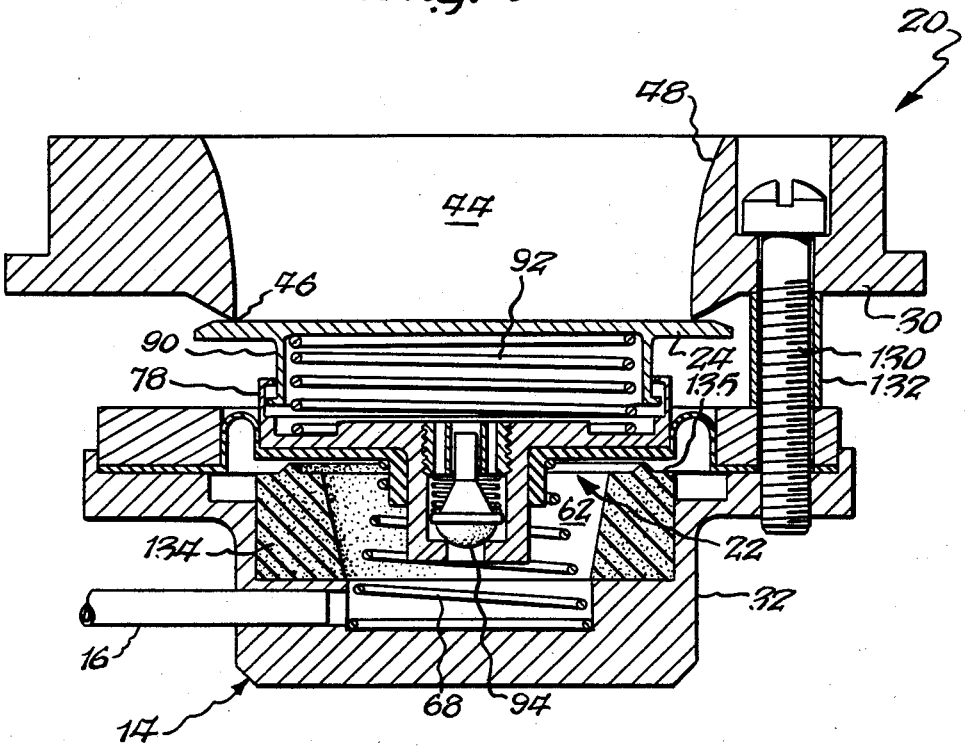
Fig. 5.
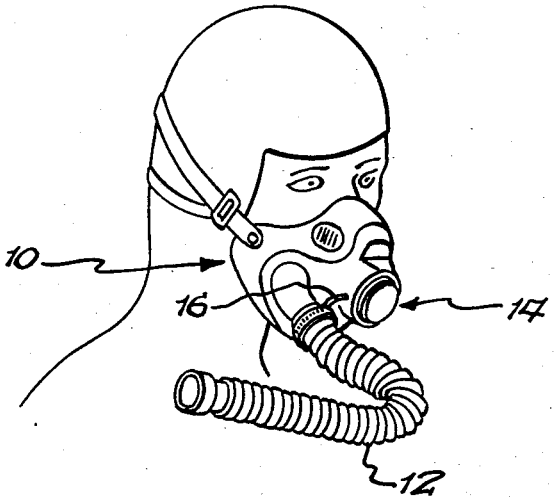
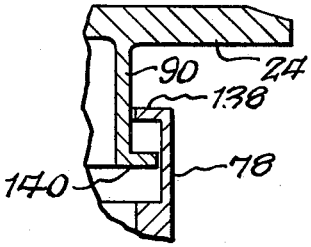
Fig. 4.

COMBINED PRESSURE COMPENSATING EXHALATION AND ANTI-SUFFOCATION VALVE

FIELD OF THE INVENTION

The present invention relates generally to breathing apparatus of the type which may be worn by an aviator, and more particularly to a valve which may be utilized with a breathing mask or helmet both as an exhalation valve and an anti-suffocation valve, which valve is pressure compensated.

PRIOR ART

Exhalation valves are well known in the prior art. One such valve is shown in U.S. Pat. No. 3,459,216, the disclosure of which is incorporated herein by reference thereto. This form of valve, slightly modified, is in commercial use today. It performs very satisfactorily as an exhalation valve. However, when utilized with a breathing mask it is also necessary to provide an anti-suffocation valve in the case that the supply of breathing gas (customarily oxygen) should fail. Various types of anti-suffocation valves are well known in the art and they generally function on the same principles. Thus, when an aviator should inhale and create a vacuum within the mask cavity, at least equal to a predetermined pressure differential, for example, approximately 6 inches of water, the valve will open and permit the aviator to breathe ambient air. The designs vary and once open the valve may stay open or it may close after the pressure differential drops below the predetermined amount. These designs perform quite satisfactorily in normal conditions. However, if a person wearing such a mask should enter water to a level below 6 inches, the water pressure will cause the valve to open (as there is now more than 6 inches of water pressure differential between the mask cavity and ambient), causing the mask cavity to flood with water. This obviously can create severe problems, particularly if the person entering the water is unconscious, as may be the case when a pilot has ejected from an aircraft over water. It should be obvserved that in most situations where an aviator enters the water the normal breathing supply is in operation and it is not necessary for the aviator to cause the anti-suffocation valve to open. However, the mere pressure of the water on the valve will cause it to open which, in some situations, could lead to drowning.

The prior art has recognized the problem of conventional anti-suffocation valves. Thus, U.S. Pat. No. 3,362,420 discloses an anti-suffocation valve which, due to a solenoid operated circuit, will not open when a sensor is in salt water. While this patent presumably operates in a satisfactory manner, it should be obvious that it is a relatively expensive design and requires a power supply for its proper operation.

OBJECTS AND SUMMARY OF THE INVENTION

It is therefore an object of the present invention to provide an improved anti-suffocation valve which is relatively simple, inexpensive and reliable in operation.

More specifically, it is an object of the present invention to provide an anti-suffocation valve which is designed in such a manner that it will not open when ambient exceeds internal pressure except when caused to open by the wearer of the breathing apparatus through the initiation of an inspiratory effort. More specifically, it is an object of the present invention to combine an anti-suffocation valve with a pressure compensated exhalation valve.

In accordance with the objects of this invention the invention is accomplished by incorporating into the known pressure compensated exhalation valve of the type shown in U.S. Pat. No. 3,459,216 additional structure which will cause the exhaust port valve to open when an inspiratory effort exceeds a predetermined pressure differential.

The foregoing, as well as other objects and advantages of this invention, will be more fully understood from the consideration of the following detailed description taken in conjunction with the accompanying drawings in which preferred forms of this invention are illustrated.

BRIEF DESCRIPTION OF THE DRAWINGS

FIG. 3 is a cross section of a modified form of a combined pressure compensated exhalation and anti-suffocation valve.

FIG. 4 is an enlarged detail of a portion of the valve shown in FIG. 3.

FIG. 5 is a schematic illustration of a breathing mask which may incorporate the valve of this invention.

DETAILED DESCRIPTION

Figure 1:
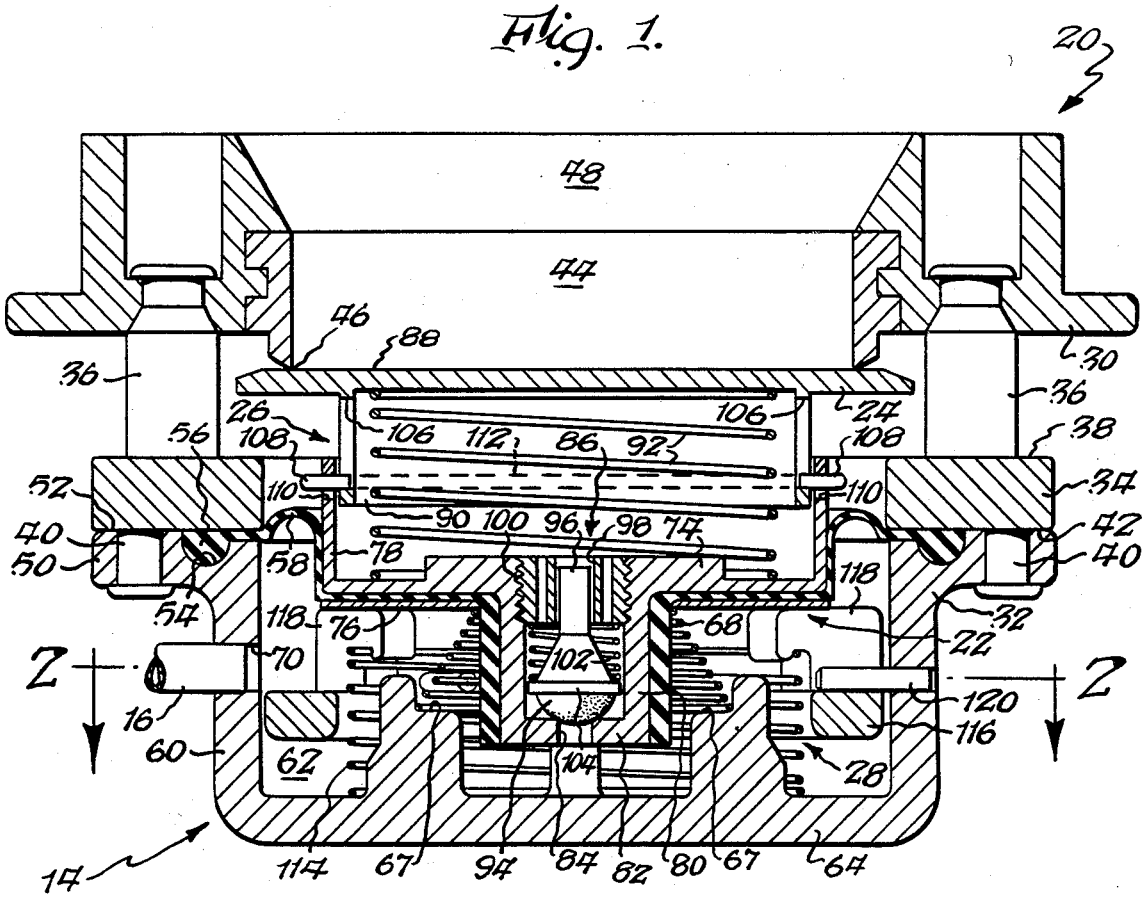
FIG. 1 is a cross-sectional view of one form of a combined pressure compensated exhalation and anti-suffocation valve.

Referring first to FIG. 5 a mask is indicated generally at 10 and is provided with an inlet tube 12 connected to a supply of breathing gas which is typically oxygen. Mounted adjacent the supply tube 12 is an exhalation valve indicated generally at 14, the exhalation valve being in communication with the mask cavity through an orifice tube 16 which may be connected with the breathing supply tube 12. While the orifice tube may be connected with the breathing tube 12 it should be noted that the pressure within the breathing tube 12 will be essentially the same as that within the mask cavity.

One form of the valve 14 is more fully illustrated in FIG. 1 to which reference will now be made. The combined pressure compensated exhalation and anti-suffocation valve includes a valve body indicated generally at 20, a movable diaphragm assembly indicated generally at 22, an exhaust port plate 24, lost motion connection means, one form of which is indicated generally at 26 in FIG. 1 and, similarly, resilient means, one form of which is indicated generally at 28 in FIG. 1.

As is conventional in the prior art, the valve body is formed of two sections, one section 30 of the valve body being adapted to be connected to the mask in an airtight relationship, and another section 32 being secured to the first section 30. To this end, an annular member 34 is provided, the member 34 having first positioning posts extending towards the first section 30 away from one side 38 of the annular member, and there being second positioning posts 40 extending away from the other side 42 of the annular member, the posts 36 and 40 being adapted to be received within suitable apertures in the first and second sections 30, 32 and being secured thereto by staking or the like. The section 30 of the valve body is cast otherwise secured about an exhaust port 44 which is provided with a hardened knife edge 46. The exhaust port 44 is in communication with a passageway which forms part of the mask cavity.

The other section 32 of the valve body has a generally cup-shaped configuration, the rim 50 having a radially outer peripheral surface 52 which is adapted to contact the other side 42 of the annular member 34. Spaced radially inwardly from this surface is an annular recess 54 which is adapted to receive a bead edge 56 of an elastomeric member 58 which forms a portion of the diaphragm assembly 22. As can be seen from FIG. 1 the bead edge 56 is securely trapped within the annular recess 54 between the member 34 and the rim 50. A closed cylindrical portion 60 is disposed radially inwardly of the rim 50 and forms a compensating pressure chamber 62. Supported by the end wall 64 of the closed cylindrical portion 60 are a plurality of spring supports 66 which are spaced equal radial distances from the center of the end wall 64. Each of the spring supports 66 is provided with a shouldered portion 67 which receives one end of a valve spring 68. The cylindrical wall of the closed cylindrical portion 60 is provided with an aperture 70 which receives one end of an orifice tube or pressure compensating tube 16, the other end of which is interconnected with the mask cavity, either directly or through a breathing supply tube.

The movable diaphragm assembly 22 includes, in addition to the elastomeric member 58, an exhaust port plate support member 74 and a protective plate 76, an annular portion of the elastomeric member 58 being sandwiched between the protective plate 76 and a portion of the exhaust port plate support member 74. One end of the spring 68 bears against the protective plate 76 as can be seen from FIG. 1. The exhaust port plate support member has a first cylindrical sleeve portion 78 which extends towards the exhaust port 44, and a second cylindrical portion 80 which extends towards the end wall 64, the second cylindrical portion being closed by an end wall 82 provided with a central aperture 84. The cylindrical portion 80 includes a safety relief indicated generally at 86, which relief means will be described in greater detail below.

The exhaust port plate 24 is a disk-like member having a surface 88 which is adapted to be contacted by the knife edge 46 of the valve seat 44 when the valve 24 is closing the exhaust port. The exhaust port valve is also provided with a cylindrical sleeve portion 90 which is telescopically received within the cylindrical sleeve portion 78, the cooperating sleeves 78 and 90 permitting telescoping movement of the exhaust port plate 24 relative to the diaphragm assembly 22. A spring 92 extends between the exhaust port plate 24 and the exhaust port plate support member 74 and normally biases the exhaust port plate away from the diaphragm assembly.

The safety relief means 86 includes a poppet valve 94 having one end of which normally closes the orifice 84 in the end wall 82. The poppet 94 is provided with a stem portion 96 which passes through a suitable aperture 98 in an apertured and threaded member 100. A spring 102 extends between the threaded member 100 and an enlarged portion 104 of the poppet 94.

The structure so far described is to a large extent disclosed in U.S. Pat. No. 3,459,216 and will operate in the same manner as the pressure compensated exhalation valve having a relief port in the compensating pressure chamber as described in said patent. In normal operation the pressure within the pressure compensating chamber 62 is equal to or, during an exhalation effort of the wearer of the mask, less than the pressure within the mask. Thus, except when the wearer of the mask exhales, the valve plate 24 will be in contact with the knife edge 46. However, when the wearer of the mask exhales the valve plate 24 will move away from the knife edge 46 causing the spring 92 and, to some degree, the spring 68 to be compressed, the exhaled gas passing between the knife edge 46 and the surface 88. The safety relief 86 is provided for overpressure conditions. Should such a condition exist within the mask cavity, the poppet 94 will move against spring pressure 102 permitting the overpressure condition, which would also exist in the compensating pressure chamber 62, to discharge to ambient. When this happens, the plate 24 and diaphragm assembly 22 will then move towards the end wall 64 thereby quickly dumping the overpressure within the mask cavity between knife edge 46 and surface 88. For more complete details of the operation of the foregoing structure reference should be made to U.S. Pat. No. 3,459,216.

In accordance with the principles of this invention lost motion connection means 26 extend between exhaust port plate 24 and the movable diaphragm assembly at 22. In this connection in the embodiment illustrated in FIG. 1, the lost motion connection means includes elongated slots 106 in the cylindrical sleeve portion 90 and pins 108 which pass through suitable apertures 110 on the cylindrical sleeve portion 78. In order to facilitate assembly the pins 108 are part of a C-shaped resilient element 112, the ends of which are normally biased towards each other.

It should be obvious that the diaphragm assembly 22 has a first range of movement with respect to the exhaust port 44 which will not cause corresponding movement of the exhaust port plate 24. However, if the diaphragm assembly 22 should move away from the exhaust port plate 24 a sufficient amount the pins 108 will engage the ends of the slots 106 and cause subsequent movement of the exhaust port plate. This can occur when the supply of breathing gas to the mask cavity fails. In this situation, if the wearer of the mask should inhale, he will cause the pressure within the compensating chamber 62 to fall below ambient (as the sensing tube permits the flow of gas from within the chamber 62 to the mask cavity.) This will in turn cause the diaphragm assembly to move away from the valve seat. If there is sufficient movement of the diaphragm assembly, caused by a sufficient inspiratory effort, the pins 108 will engage the ends of the slots 106 and cause subsequent movement of the exhaust port plate 24 thereby moving the surface 88 away from the edge 46 permitting ambient gas to flow past the knife edge 46 into the passageway 48 through port 44. To control the force required to initiate such operation, resilient means 28 are provided. In the embodiment illustrated in FIG. 1 the resilient means includes a spring 114 which extends between the inner surface of the end wall 64 and an annular spring retainer 116 provided with upstanding portions 118, the upper surface of which engages the protective plate 76. There are spaces between the portions 118 which receive dowels 120 which limit the upward movement of the spring retainer 116. Because of this construction the diaphragm assembly 22 can move away from the spring retainer 116, 118 during normal operation, but will engage the spring retainer during an inspiratory effort great enough to provide the necessary pressure differential in the chamber 62 to overcome spring 114.

Figure 2:
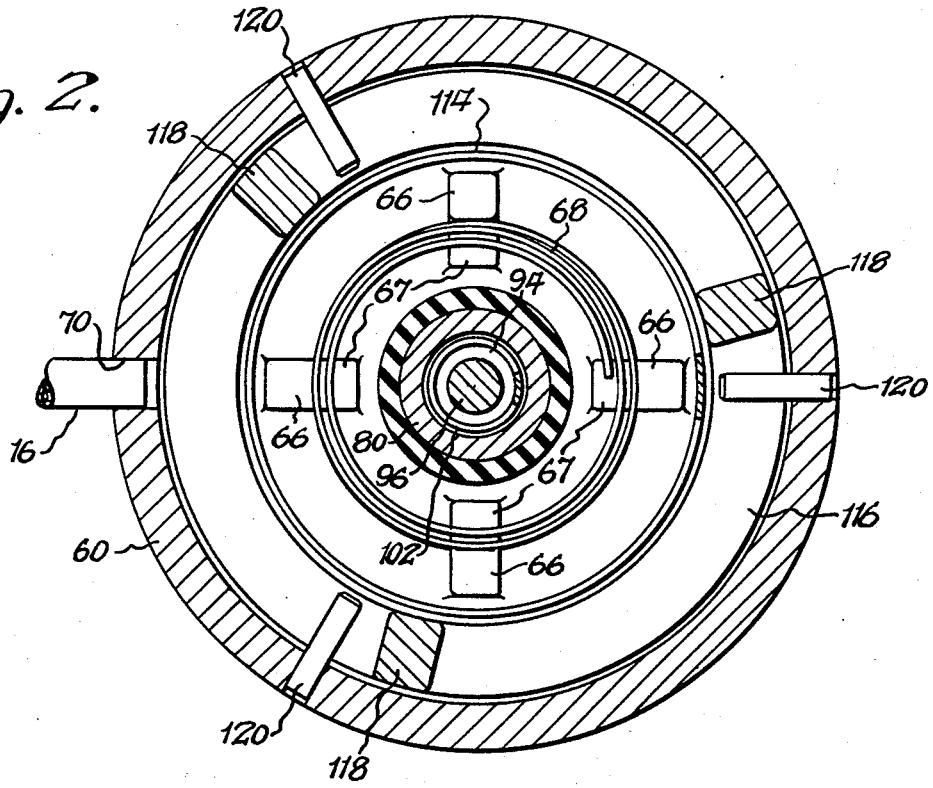
FIG. 2 is a sectional view taken generally along the line 2—2 in FIG. 1.

In the structure illustrated in FIGS. 1 and 2 a pin and slot are utilized for forming the lost motion connection means, and a coil or helical spring is utilized for forming the resilient means. However, other forms of construction could be utilized and FIGS. 3 and 4 illustrate such alternate forms. As the parts are essentially the same in these two figures, only the portions which differ materially will be described.

Referring now in detail to FIG. 3, it can be seen that the two portions 30 and 32 of the valve body 20 are held relative to each other by a screw fastener 130 and spacers 132. Mounted within the compensating pressure chamber 62 is an annular elastomeric foam member 134 having a countoured surface 135 which is adapted to be engaged by the diaphragm assembly to give a tailored spring rate. In addition, the cylindrical sleeve portions 78 and 90 are provided with overhanging lips 138 and 140 to provide the suitable lost motion connection. It should be obvious that while the structure just described differs in details it will perform functionally in an equivalent manner to that described above in connection with FIG. 1.

While various embodiments of this invention have been described above in conjunction with the varying figures, it should be obvious to those having ordinary skill in the art that other modifications can be made. Therefore, it is to be understood that this invention is not limited to the particular details shown and described above, but that, in fact, widely differing means may be employed in the practice of the broader aspects of this invention.

What is claimed is:

1. A combined pressure compensating exhalation and anit-suffocation valve in combination with a breathing mask of the type having a mask cavity adjacent the wearer's nose and/or mouth, said mask cavity normally being supplied with breathing gas from a pressurized supply; said valve including a valve body provided with an exhaust port and a compensating pressure chamber having an orifice in one wall thereof, said orifice being fluidically connected to the mask cavity;

a movable diaphragm assembly mounted to said valve body, such that said diaphragm assembly moves toward and away from said exhaust port the inner surface of which forms one wall of said pressure chamber, and the outer surface of the diaphragm assembly being exposed to ambient pressures, means for biasing said diaphragm assembly outwardly from said pressure chamber toward said exhaust port; and an exhaust port plate movably mounted on said diaphragm assembly to move towards and away from said diaphragm assembly, means for biasing said exhaust port plate away from said diaphragm assembly toward said exhaust port said diaphragm assembly and said exhaust port plate being oriented on said valve body such that said exhaust port plate covers said exhaust port during inhalation, and said exhaust port plate normally moving away from exhaust port toward said diaphragm assembly during exhalation to uncover said exhaust port;

said combined pressure compensated exhalation and anti-suffocation valve further being characterized by the provision of;

lost motion connection means extending between the diaphragm assembly and the exhaust port plate and capable of permitting the exhaust port plate to move relative to the diaphragm assembly within a predetermined range of movements, the parts being so arranged and constructed that if during an inspiratory effort the diaphragm assembly attempts to move away from the exhaust port plate a distance greater than that permitted by the lost motion connection means, as would be the case as a result of negative inhalation pressure sensed in the pressure chamber, the diaphragm assembly acting through the lost motion connection means will cause corresponding movement of the exhaust port plate thereby opening the mask cavity to ambient.

2. The combined pressure compensated exhalation and anti-suffocation valve as set forth in claim 1 further characterized by the provision of resilient means mounted within said compensated pressure chamber and engageable by the inner surface of said movable diaphragm assembly just prior to the exhaust port plate uncovering the exhaust port during an inhalation effort.

3. The combined pressure compensated exhalation and anti-suffocation valve as set forth in claim 2 wherein said resilient means includes a coil spring.

4. The combined pressure compensated exhalation and anti-suffocation valve as set forth in claim 3 wherein said resilient means further includes an annular member having first and second opposed surfaces, said annular member being normally maintained in place by said coil spring and a plurality of dowels carried by said valve body, said coil spring bearing against the first surface of the annular member and normally biasing the second surface of the annular member into contact with said plurality of dowels, said dowels limiting the movement of the annular member towards said diaphragm assembly so that during normal operation of the combined pressure compensated exhalation and anti-suffocation valve, the annular member does not contact the diaphragm assembly.

5. The combined pressure compensated exhalation and anti-suffocation valve as set forth in claim 2 wherein said resilient means includes an elastomeric foam member.

6. The combined pressure compensated exhalation and anti-suffocation valve as set forth in claim 5 wherein said resilient foam member is contoured to provide a tailored spring rate.

7. The combined pressure compensated exhalation and anti-suffocation valve as set forth in claim 1 further characterized by the provision of safety relief means for exhausting fluid through said exhaust port without regard to fluctuations in the ambient pressure, said safety relief means being openable by fluid pressure when said breathing fluid supply system becomes overpressure compensated.

8. The combined pressure compensated exhalation and anti-suffocation valve as set forth in claim 1 wherein said movable diaphragm assembly incudes a cylindrical sleeve supported by the outer surface of said diaphragm assembly and extending away towards said exhaust port, and said exhaust port plate includes a cylindrical sleeve concentric with the cylindrical sleeve on the diaphragm assembly and extending towards said diaphragm assembly, the parts being sized with respect to each other so that they guide one another, and said lost motion connection means includes overhanging lips on said cylindrical sleeves whereby when the diaphragm assembly moves away from the exhaust port a sufficient amount, the overhanging lip on the sleeve supported by said diaphragm assembly engages the overhanging lip on the sleeve supported by the exhaust port plate to cause corresponding movement of said exhaust port plate.

9. The combined pressure compensated exhalation and anti-suffocation valve as set forth in claim 1 wherein said movable diaphragm assembly includes a cylindrical sleeve supported by the outer surface of said diaphragm assembly and extending away towards said exhaust port, and said exhaust port plate includes a cylindrical sleeve concentric with the cylindrical sleeve on the diaphragm assembly and extending towards said diaphragm, the parts being sized with respect to each other so that they guide one another, said lost motion connection means including elongated slots in one of said cylindrical sleeves, and pins mounted on the other of said cylindrical sleeves and projecting into said slots whereby, when the diaphragm moves away from the exhaust port a sufficient amount the pins on the other cylindrical sleeve engages the end of the slot on the one cylindrical sleeve to cause corresponding movement of said exhaust port plate.

10. The combined pressure compensated exhalation and anti-suffocation valve as set forth in claim 9 wherein said pins are interconnected to each other by a C-shaped spring-like element, said C-shaped spring-like element normally biasing the pins towards each other.

* * * * *